US006164798A

United States Patent [19]

Wordin

[11] Patent Number: 6,164,798

[45] Date of Patent: Dec. 26, 2000

[54] ASYMMETRICAL COMPOUND REFLECTORS FOR FLUORESCENT LIGHT FIXTURES

[76] Inventor: John Joseph Wordin, 735 N. 900 East, Shelley, Id. 83274

[21] Appl. No.: 09/336,482

[22] Filed: Jun. 15, 1999

Related U.S. Application Data

[63] Continuation-in-part of application No. 08/746,548, Nov. 13, 1996, Pat. No. 6,007,220.

[51] Int. Cl.[7] ..... F21V 7/00

[52] U.S. Cl. ..... 362/297; 362/260; 362/346

[58] Field of Search ..... 362/297, 304, 362/346, 260

[56] References Cited

U.S. PATENT DOCUMENTS

| | | | |
|---|---|---|---|
| 3,492,474 | 1/1970 | Yamaguchi et al. | 362/350 |
| 4,089,047 | 5/1978 | Luderitz | 362/297 |
| 4,295,186 | 10/1981 | Sugiura et al. | 362/217 |
| 4,683,526 | 7/1987 | Krogsrud et al. | 362/346 |
| 4,868,727 | 9/1989 | Ponds et al. | 362/344 |
| 5,555,162 | 9/1996 | Shemitz | 362/225 |
| 6,007,220 | 12/1999 | Wordin | 362/296 |

*Primary Examiner*—Stephen Husar

[57] ABSTRACT

A spectral asymmetric compound reflector having a cross section in the form of multiple hyperbolas is disclosed. Light fixtures utilizing these reflectors provide an adequate light level, tends to eliminate shadows, save energy, and provide very agreeable illumination.

3 Claims, 2 Drawing Sheets

ASYMMETRICAL COMPOUND REFLECTORS FOR FLUORESCENT LIGHT FIXTURES

BACKGROUND

This is a continuation-in-part of patent application Ser. No. 08/746,548, filed Nov. 13, 1996, now patent No. 6,007,220.

This invention relates to reflectors, specifically, to reflectors in the cross-sectional shape of conic sections for fluorescent light fixtures. Other patents have taught how to use reflectors on light fixtures which have a cross-sectional shape generally hyperbolic, generally elliptic, or generally parabolic. For example, U.S. Pat. No. 4,089,047 "Trifocal Mirror-Reflector" Luderitz, May 9, 1978 uses reflectors with elliptical cross-sections with the feature of one set of focuses of the ellipses being coincident and with the other focuses located at the ceiling level. These incandescent light fixtures use only reflected light with the embodiment designed such that all direct light coming from the light source is blocked. This patent would restrict the fixture to something small in diameter in order to meet the requirement of having one set of focuses coincident. Having all direct light blocked seriously limits the efficiency and usefulness of the lamp. A hyperbolic reflection surface is added to the lamp in another embodiment which is described, however, no diagram of the configuration is provided and the juxtaposition of the light source and the focus of the hyperbola is not taught.

U.S. Pat. No. 4,683,526 "Asymmetric Lamp" Krogsrad and Sorensen, Jul. 28, 1987 claims a desk lamp with a reflector in the shape of a parabola formed from a series of triangular facets. This patent claims a method to approximately construct at reasonable cost, a curved reflection surface to improve the light delivery from the lamp.

U.S. Pat. No. 4,868,727 "Light Fixture with Integral Reflector and Socket Shield" Ponds, Kevin; Calloway, John, Sep. 19, 1989 claims a security light with a high intensity halogen bulb with a reflector behind it. At each socket housing location, the reflector is slit and an arc piece is formed from the released metal segment. The arc piece forms an effective shield over the socket and related components. The physical location of the bulb relative to the reflector is not taught. The shape of the reflector is either parabolic or hyperbolic, without a specific embodiment as to the position of the light source relative to the reflector or the focus of the conic section. With a bulb of 300 watts, there is no attempt to provide energy savings.

U.S. Pat. No. 4,295,186 "Slit Illuminating Device" Sugiura, Muneharu; Sagara, Seiji, Oct. 13, 1981 is a lighting device having a plurality of linear surface mirrors, each partially surrounding a light source. The reflector approximates an ellipticaL-shaped reflector. Its purpose was for use in a reproduction machine.

U.S. Pat. No. 3,492,474, "Reflector With Compound Curvature Reflecting Surface" Yamaguchi, Seiichi; Hishinuma, Satoshi, Jan. 27,1970 is a 3-dimensional concavo-convex reflector for use as a headlamp on an automobile. At least part of the surface is formed having a hyperbolic curvature in the horizontal plane. No attempt is made to provide energy savings.

Illumination Engineer's Association Handbook shows the general theory of the use of a hyperbola as a reflector but without showing a specific embodiment.

Although there are a number of fluorescent light fixtures on the market, few seem to utilize the direct light and reflected light coming from the light source to full advantage. Reflection surfaces are painted milky white, which has a medium reflectance. Some reflectors are being made on special order to retrofit existing light fixtures, reduce the number of fluorescent tubes, and thus improve the light efficiency and energy utilization. These retrofit reflectors are fabricated by bending them into rectangular facets thus approximating a parabola in cross-sectional shape. A highly reflective material, such as Silverlux by 3M Company, applied to the surface of a thin aluminum sheet, is being used on these reflectors.

Generally, fluorescent light fixtures, which are designed to provide illumination for an area, should:

a. Uniformly illuminate the area.

b. Minimize the formation of shadows.

c. Provide light agreeable for human activity.

d. Minimize the use of energy while providing an adequate level of illumination.

Accordingly, there is a need for new, optimized, light fixtures which will provide uniform light patterns coupled with an adequate level of illumination, and providing substantial energy savings. They must be suitable for use in new building construction or retrofit to existing structures, for illumination of art works or advertising signs, and for use in homes, stores, and offices.

OBJECTS AND ADVANTAGES

Modern civilization has moved indoors and functions around the clock. Thus, there is a need for low cost lighting in buildings, offices, warehouses, barns, museums, homes, and where ever there is human activity. Electrical rates continue to slowly rise and, as a strategy to cope with these rate increases, conservation is one approach. Because much human activity takes place indoors under artificial light, the light level must be high enough so quality work can be conducted, sporting events well lit, and kitchen areas adequately lit for food preparation. Shadows produced by point sources of light are a nuisance. Similarly, uneven lighting in work areas creates eyestrain. Uneven lighting of advertising displays sacrifices impact. Light and dark areas on paintings or tapestries on exhibit in art museums detracts from the presentation of such artistic works.

Approximately 80% of what human beings learn come through the sense of sight. We see objects by reflected light. Therefore, it is important that human factors of illumination in a room, office, or other work place are bright, have good color rendition, and exhibit a character and quality which is most pleasing.

Accordingly, it is an object of this invention to provide an occupied area with fluorescent light fixtures which provide an adequate level of illumination while substantially saving energy compared to existing light fixtures. Another object of this invention is to minimize or eliminate shadows and to provide an illuminated work area that is lighted in a uniform manner. It is a further object of this invention to provide illumination to an area by light fixtures projecting light which has a most pleasing character and quality.

THEORY OF OPERATION

The law of reflection is the essential physical principle upon which this invention is based. It states:

When an energy wave incident upon a flat or curved surface is reflected, the angles of incidence and of reflection are equal and lie in the same plane.

Various materials and types of surfaces reflect light at different reflectance. A diffuse surface can reflect 10% to 60% of incident light while a spectral surface can reflect 80% to 95% of the incident light. Since high efficiency is desired to achieve energy savings, the surface finish chosen for the reflector is spectral. Polished aluminum, polished stainless steel, and a plastic laminate called Silverlux by 3M Company all qualify as possible candidates for reflector surfaces. Material selection for the reflector surface is not limited to this list of materials, others surely also qualify.

A second ingredient needed is the shape of the reflector. The classic shape used in the past for light fixtures has been the parabola, which reflects the light downward. For this current invention, selection is limited to the use of one of the conic sections, namely, the hyperbola. This cross-sectional shape is selected because the light is reflected downward and outward, providing a more uniform level of illumination. The illuminated surface receives the direct light plus the light reflected from the hyperbolic reflector.

Equations defining the hyperbola can be found in Marks' Standard Handbook for Mechanical Engineers, $8^{th}$ Edition, 1979. A hyperbola has two branches. There is a first focal point associated with the first branch of the curve and a second focal point associated with the second branch of the curve. In order to construct a light fixture using these principles, a reflector in the form of a first branch of a hyperbola is placed behind a light source. The light source is located coincident with the first focal point. The reflected light seems to come from the second focal point according to the law of reflection. Light coming from more than one source tends to eliminate shadows.

Testing of a prototype light fixture has demonstrated that the illumination from a fixture with a hyperbolic asymmetrical compound reflector is very agreeable to human subjects.

Energy saving results from using a high efficiency reflector. Two fluorescent tubes, as found in present day light fixtures, can be replace by a single tube with an associated reflector without loss of illumination level. Thus the energy requirements of the fixture are reduced because only one electrically active tube is needed instead of two. A passive reflector has replaced the other active tube.

DRAWING FIGURES

GENERAL DESCRIPTIONS OF CONIC SECTIONS USED AS A REFLECTOR SHAPE

Figure 1:
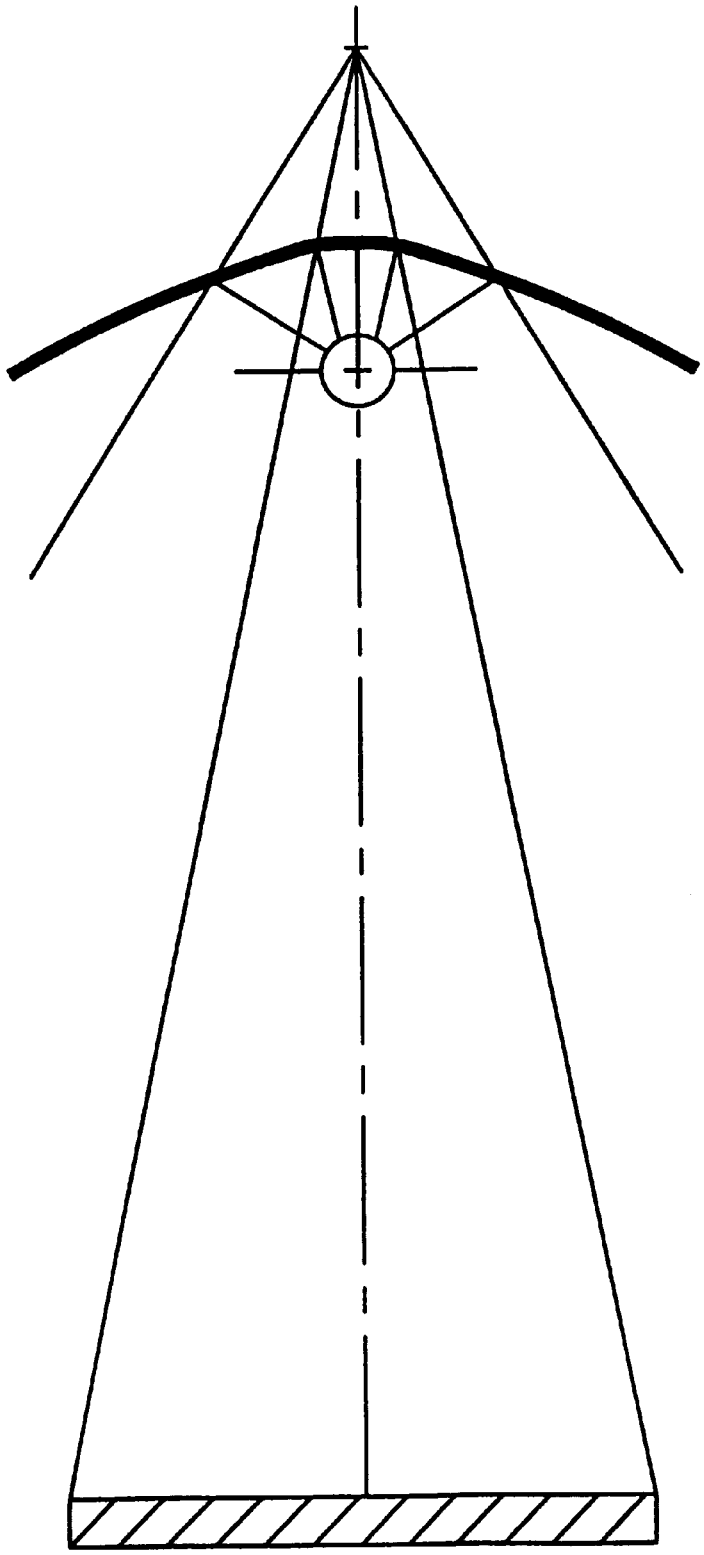
PRIOR ART FIGURE 1
FIG. 1 is a general view of reflected energy from a hyperbolic reflector.

When a reflector in the shape of a hyperbola is located behind an extended light source, and the center of the light source is located coincident with the primary focus of the hyperbola, the reflected light appears to have originated from the other focus, herein referred to as the virtual focus, of the hyperbola. See FIG. 1. The pencil of light rays appear as a fan-shape providing a natural diffusion pattern of reflected light as if it were emanating from the virtual focus. Thus, the direct light is a pencil of light rays from the primary focus and the reflected light is a pencil of light rays from the virtual focus. This dual set of light sources tends to eliminate shadows from objects placed under the light fixture. The hyperbolic reflector provides a broad diffusing light pattern on the illuminated surface. The reflector projects the reflected light downward and outward.

DETAILED DESCRIPTION OF THE MAIN EMBODIMENT

Figure 2:
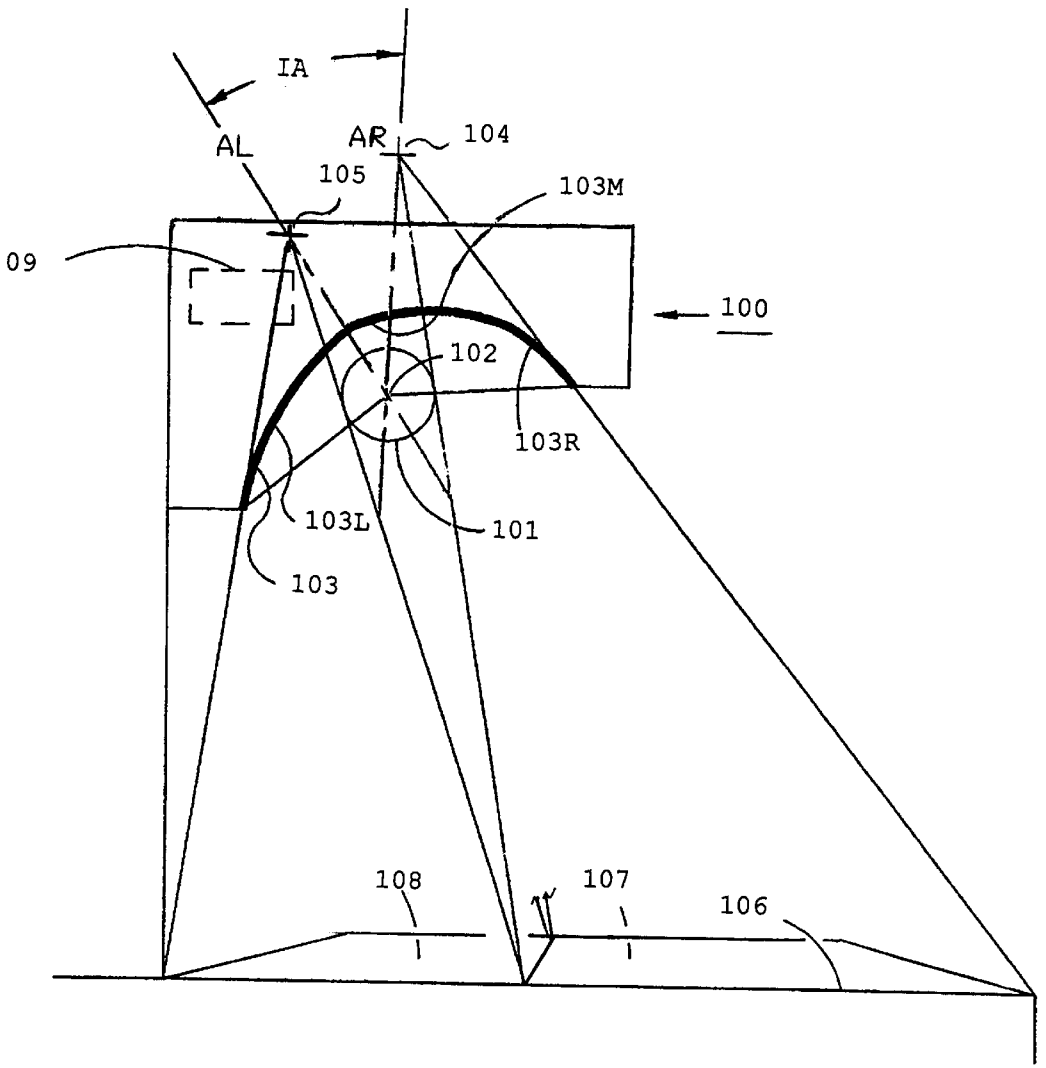
FIG. 2 shows an asymmetrical fluorescent light fixture with a single elongated light source and with an asymmetrical compound reflector behind the light source, hyperbolic in shape, composed of 2 partial hyperbolic line segments connected by a short arcuate section.

The preferred embodiment for this invention is shown in FIG. 2, where a fluorescent light fixture with hyperbolic cross-sectional spectral reflector shape is presented.

FIG. 2 shows an electric light fixture having a single elongated light source combined with a compound reflector composed of two different sizes of hyperbolically curved reflector sections plus a curved transition section making it an asymmetric compound reflector. The light source is a fluorescent light tube.

In FIG. 2 is shown a light fixture 100, using an elongated light source 101, located coincident with a primary focus 102 of an asymmetrical compound reflector 103, which is composed of three sections. A first reflector section 103R, forming along a hyperbolic curve, has as its first focus the primary focus 102, and having a first virtual focus 104 associated with it. The first reflector section 103R has a first axis AR consisting of a straight line connecting the primary focus 102 with the virtual focus 104. In similar fashion, there is a second reflector section 103L, also hyperbolically shaped, and having as its first focus the same primary focus 102 as the first reflector section 103R. There is a second virtual focus 105 associated with the second reflector section 103L. The second reflector section 103L has a second axis AL consisting of a straight line connecting the primary focus 102 with the virtual focus 105. A transition center reflector section 103M, arcuate in shape, spans the gap between the first reflector section 103L and the second reflector section 103R, all connecting to form the continuous asymmetrical compound reflector 103. The axis AR and the axis AL intersect at the primary focus 102 making these axes non-parallel.

The asymmetrical compound reflector 103 reflects light coming from the light source 101 to a surface 106 to be illuminated by the light fixture. Because of the asymmetrical nature of the reflector, the surface 106 is lit in two contiguous areas, 107 and 108. This is accomplished by appropriate selection of the included angle, angle IA, between the two axes AR and AL.

The surface 106 receives reflected light and direct light coming from the light source 101. The surface 106 can be horizontal as shown or surface 106 could be vertical. The vertical orientation of surface 106 can be illustrated by rotating FIG. 2 through an angle of 90 degrees either to the left or the right.

A ballast 107 is located within the fixture. Associated wiring from the ballast 107 to the light source 101 is accomplished according to the known art for fluorescent light fixtures. A translucent cover (not shown) to control glare can be added per the known art.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims which are appended.

I claim:

1. An asymmetrical compound reflector comprising:

a) a first reflector section forming along a curve of a first hyperbola, said first hyperbola having a first primary focus and a first virtual focus, and having a first axis defined by a straight line connecting said first primary focus and said first virtual focus;

b) a second reflector section forming along a curve of a second hyperbola, said second hyperbola having a second primary focus and a second virtual focus, and having a second axis defined by a straight line connecting said second primary focus and said second virtual focus;

c) a third reflector section forming an arc;

d) said first reflector section and said second reflector section each joining together on either side of said third reflector section forming a continuous asymmetrical compound reflector, and said first primary focus and said second primary focus are coincident, and having said first axis and said second axis nonparallel.

2. The asymmetrical compound reflector of claim 1 wherein the included angle between said first axis and said second axis is selected for producing contiguous reflected light patterns on an illuminated surface.

3. A fluorescent light fixture comprising:

a) an asymmetrical compound reflector with a primary focus of claim 1, b) a fluorescent light tube, c) wherein said fluorescent light tube is located coincident with said primary focus of said asymmetrical compound reflector whereby said fluorescent light fixture produces adequate, agreeable illumination while saving energy.

* * * * *